US008348870B2

(12) United States Patent
Nagamitsu et al.

(10) Patent No.: US 8,348,870 B2
(45) Date of Patent: Jan. 8, 2013

(54) MASSAGE APPARATUS USING RECIPROCATING PLATES

(75) Inventors: Tomoki Nagamitsu, Saihaku-gun (JP); Nobuhisa Matsuura, Yonago (JP)

(73) Assignee: Family Co., Ltd., Osaka-shi (JP)

( * ) Notice: Subject to any disclaimer, the term of this patent is extended or adjusted under 35 U.S.C. 154(b) by 508 days.

(21) Appl. No.: 12/593,878

(22) PCT Filed: Mar. 3, 2008

(86) PCT No.: PCT/JP2008/000421

§ 371 (c)(1),
(2), (4) Date: Nov. 17, 2009

(87) PCT Pub. No.: WO2008/129760

PCT Pub. Date: Oct. 30, 2008

(65) Prior Publication Data

US 2010/0137758 A1 Jun. 3, 2010

(30) Foreign Application Priority Data

Mar. 30, 2007 (JP) ..... 2007-091613

(51) Int. Cl.
*A61H 11/02* (2006.01)
*A61H 7/00* (2006.01)

(52) U.S. Cl. ..... 601/101; 601/97; 601/103; 601/148; 601/149; 601/150

(58) Field of Classification Search ..... 601/22, 601/29, 34, 51–52, 89–90, 96–104, 115–116, 601/148–149, 151
See application file for complete search history.

(56) References Cited

U.S. PATENT DOCUMENTS 5,261,394 A * 11/1993 Mulligan et al. ..... 601/108
6,540,701 B1 * 4/2003 Inada ..... 601/99
7,041,070 B2 * 5/2006 Hsieh ..... 601/90
(Continued)

FOREIGN PATENT DOCUMENTS

JP 50-136994 10/1975
(Continued)

OTHER PUBLICATIONS

ISA Japan, International Search Report of PCT/JP2008/000421, Apr. 22, 2008, WIPO, 2 pages.

*Primary Examiner* — Justine Yu
*Assistant Examiner* — Douglas Sul
(74) *Attorney, Agent, or Firm* — Alleman Hall McCoy Russell & Tuttle LLP

(57) ABSTRACT

A massaging apparatus capable of performing rubbing-massage properly with respect to a body part of a user having various shapes is provided. A massaging apparatus of the present invention includes a first massaging unit including a pair of massaging plates which are disposed at both sides of a body part of a user so as to sandwich the body part, a driving force transmission unit configured to cause the massaging plates to reciprocate in a direction along a side surface of the body part, and air bags which are disposed outside the massaging plates and are expanded and contracted by air supply and exhaust, to change a distance between the pair of massaging plates, wherein the massaging plates are reciprocatable along the side surface of the body part in a state where the air bags are expanded.

7 Claims, 10 Drawing Sheets

U.S. PATENT DOCUMENTS

| | | | | |
|---|---|---|---|---|
| 2006/0036202 | A1* | 2/2006 | Iwata et al. | 601/88 |
| 2006/0149173 | A1* | 7/2006 | Hsieh | 601/90 |
| 2008/0091129 | A1* | 4/2008 | Chen | 601/98 |

FOREIGN PATENT DOCUMENTS

| | | | |
|---|---|---|---|
| JP | 61-168353 | | 7/1986 |
| JP | 5-337157 | | 12/1993 |
| JP | 2001258971 | A | 9/2001 |
| JP | 2002143249 | A | 5/2002 |
| JP | 2005-349123 | | 12/2005 |
| JP | 2006296567 | A | 11/2006 |
| JP | 2006340772 | A | 12/2006 |

* cited by examiner

MASSAGE APPARATUS USING RECIPROCATING PLATES

TECHNICAL FIELD

The present invention relates to a massaging apparatus capable of rubbing-massage from both sides with respect to body parts of a user such as a leg or an arm.

BACKGROUND ART

Conventionally, there is proposed a massaging apparatus which rubbing-massages body parts such as a lower leg of a user (e.g., see patent document 1). The massaging apparatus includes a pair of massaging members arranged with a predetermined distance between them and is configured to cause the pair of massaging members to reciprocate in a state where the body part is sandwiched between them, carrying out rubbing-massage with respect to the sandwiched body part.

Patent document 1: Japanese Laid-Open Patent Application Publication No. 2005-349123

DISCLOSURE OF THE INVENTION

Problem to be Solved by the Invention

However, the massaging apparatus disclosed in the above patent document 1 is incapable of properly carrying out rubbing-massage with respect to all body parts of the user having various shapes. In greater detail, for example, the shape of calves is varied from user to user, and a width of the calves in a rightward and leftward direction increases and decreases in the longitudinal direction of the lower leg. During the rubbing-massage, the pair of massaging members reciprocate along the longitudinal direction of the lower leg, changing the position at which the massaging members are opposite to the calves, with a lapse of time.

Patent document 1 discloses a means for causing the pair of massaging members to reciprocate to be close to and away from each other to perform kneading-massage and a means for causing the pair of massaging members to reciprocate along the longitudinal direction of the lower leg to perform rubbing-massage. However, these means are used only selectively. Since the pair of massaging members cannot be moved to be closer to and away from each other according to a change in the shape (especially, a change in a dimension in the rightward and leftward direction) of the body part during the rubbing-massage, the rubbing-massage cannot be performed properly with respect to the body part, such as the calves, with a substantially equal pressing force.

An object of the present invention is to provide a massaging apparatus capable of performing rubbing-massage properly with respect to the body part of users having various shapes.

Means for Solving the Problem

The present invention has been made under the circumstances, and a massaging apparatus of the present invention comprises a rubbing unit including a pair of massaging plates which are disposed at both sides of a body part of a user so as to sandwich the body part; a rubbing driving unit configured to cause the massaging plates to reciprocate in a direction along a side surface of the body part; and air bags which are disposed outside the massaging plates and are expanded and contracted by air supply and exhaust, to change a distance between the pair of massaging plates; wherein the massaging plates are reciprocatable along the side surface of the body part in a state where the air bags are expanded.

In such a configuration, when the shape of the body part which is opposite to the massaging plate changes during the rubbing-massage, the air bags in an expanded state receive a pressing force from the body part via the massaging plate and are thereby deformed. Therefore, the massaging plate sandwiched between the body part and the air bags is caused to change its position according to the deformation of the air bags (i.e., according to a change in the shape of the body part) and carries out rubbing-massage properly.

The massaging plates may be coupled to the rubbing driving unit by a hinge member having flexibility. In such a configuration, since the pair of massaging plates are capable of changing relative directions as well as a distance between them, they are capable of carrying out rubbing-massage properly according to the change in the shape of the body part.

The air bags may be expandable and contractable during the reciprocation of the massaging plates. In such a configuration, the pressing force applied to the body part by the massaging plates can be changed according to the user's preference even during the rubbing-massage.

The pair of massaging plates may have opposite surfaces which are formed with raised fabrics. In such a configuration, friction resistance between the massaging plate and the body part can be reduced.

The air bags may be arranged to have a length corresponding to a reciprocating distance of the massaging plates. In such a configuration, the position of the massaging plates can be changed by the air bags regardless of the position of the massaging plates during the rubbing-massage.

Plural air bags may be provided along a direction in which the massaging plates reciprocate. In such a configuration, the degree of expansion of the air bags corresponding to respective portions can be adjusted according to the shape of the body part which is subjected to the rubbing-massage. For example, when the lower leg is rubbing-massaged, the air bags corresponding to the ankle and its vicinity, having a relatively small dimension in the rightward and leftward dimension, are expanded to a larger amount, while the air bags corresponding to the knee and its vicinity, having a relatively large dimension in the rightward and leftward direction, are expanded to a smaller amount. Thus, the rubbing-massage can be performed properly according to the change in the shape of the body part.

The massaging apparatus may further comprise a back surface massaging unit configured to massage a back portion of the body part; wherein the back surface massaging unit is operable in association with the rubbing unit. In such a configuration, the back portion of the body part can be massaged while properly carrying out the rubbing-massage with respect to the body part as described above.

Effects of the Invention

In accordance with the present invention, a massaging apparatus can be provided, which is capable of properly performing rubbing-massage with respect to body parts of users having various shapes.

EXPLANATION OF REFERENCE NUMERALS

Figure 1:
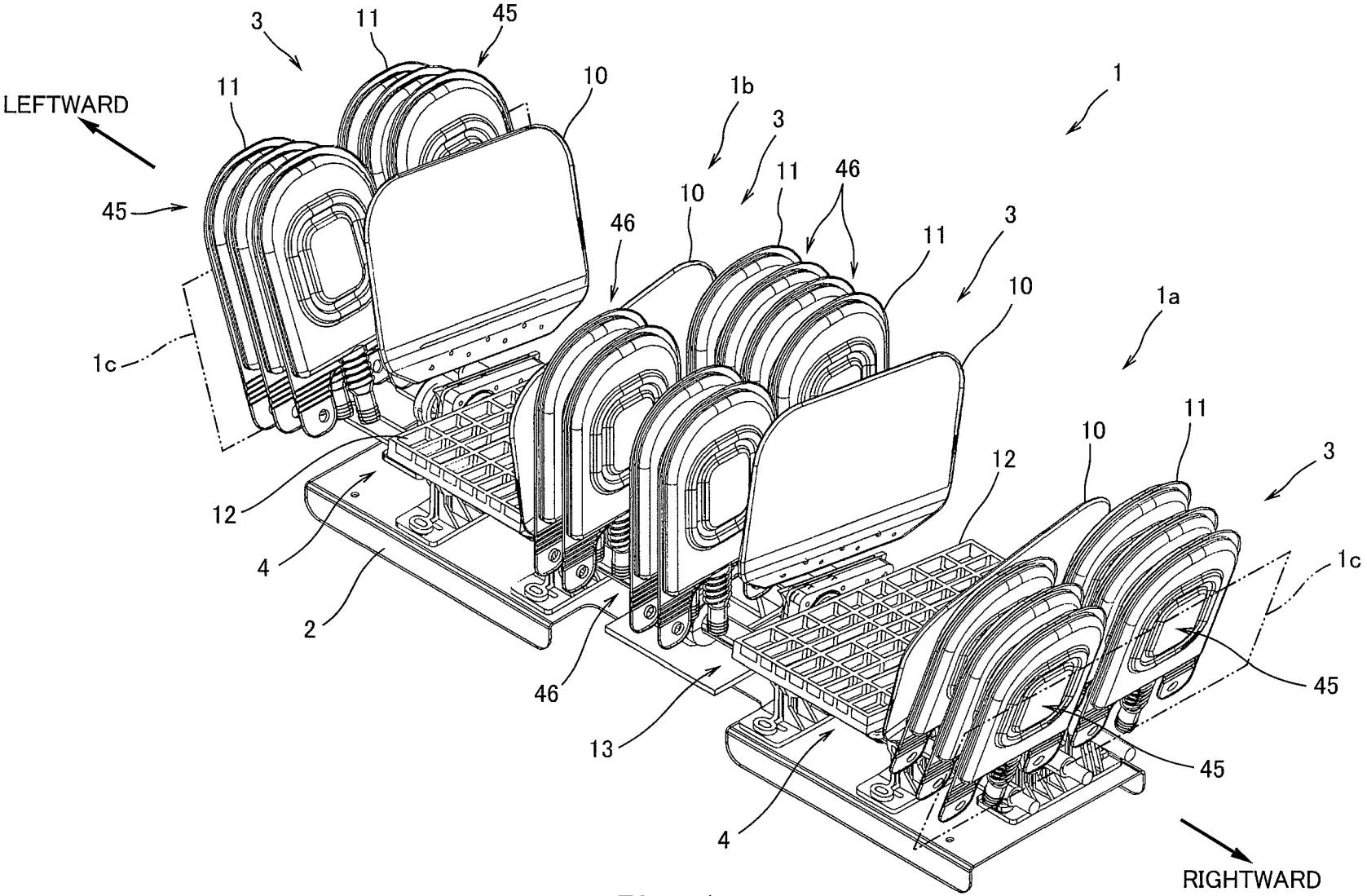
FIG. 1 is a perspective view showing an external configuration of a massaging apparatus according to an Embodiment of the present invention.

1 massaging apparatus
1*a* right massager
1*b* left massager
1*c* wall surface
3 first massaging unit
4 second massaging unit
5 motor
10 side surface massaging plate
10*a* opposite surface
11 air bag
12 back surface massaging plate
13 driving force transmission mechanism (rubbing driving unit)
41 hinge plate
45, 46 air bag unit
60 controller
63 operation device
70 back surface massaging unit

BEST MODE FOR CARRYING OUT THE INVENTION

Hereinafter, a massaging apparatus according to an embodiment of the present invention will be described specifically with reference to the drawings.

Figure 2:
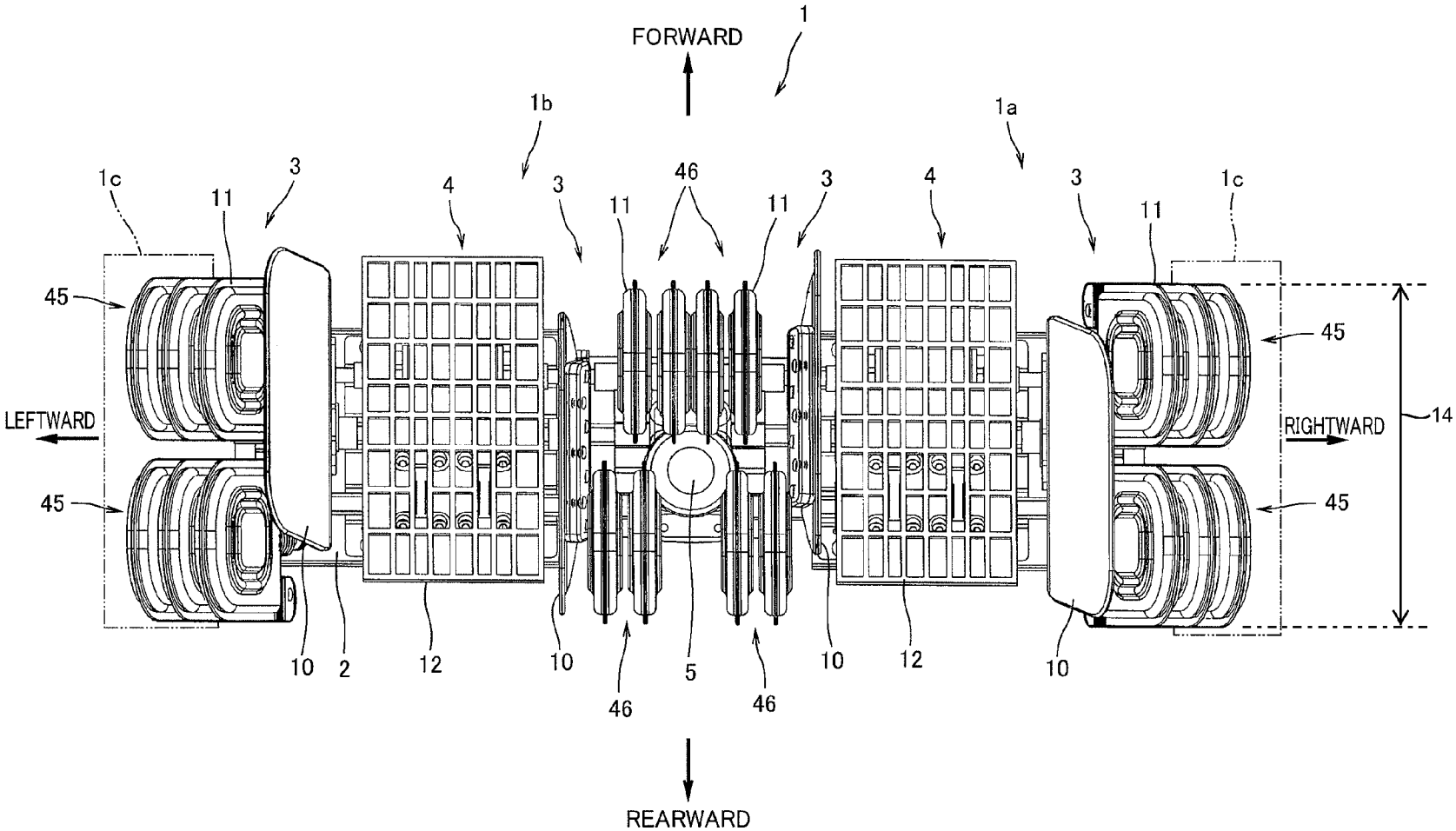
FIG. 2 is a plan view of the massaging apparatus of FIG. 1.
Figure 8:
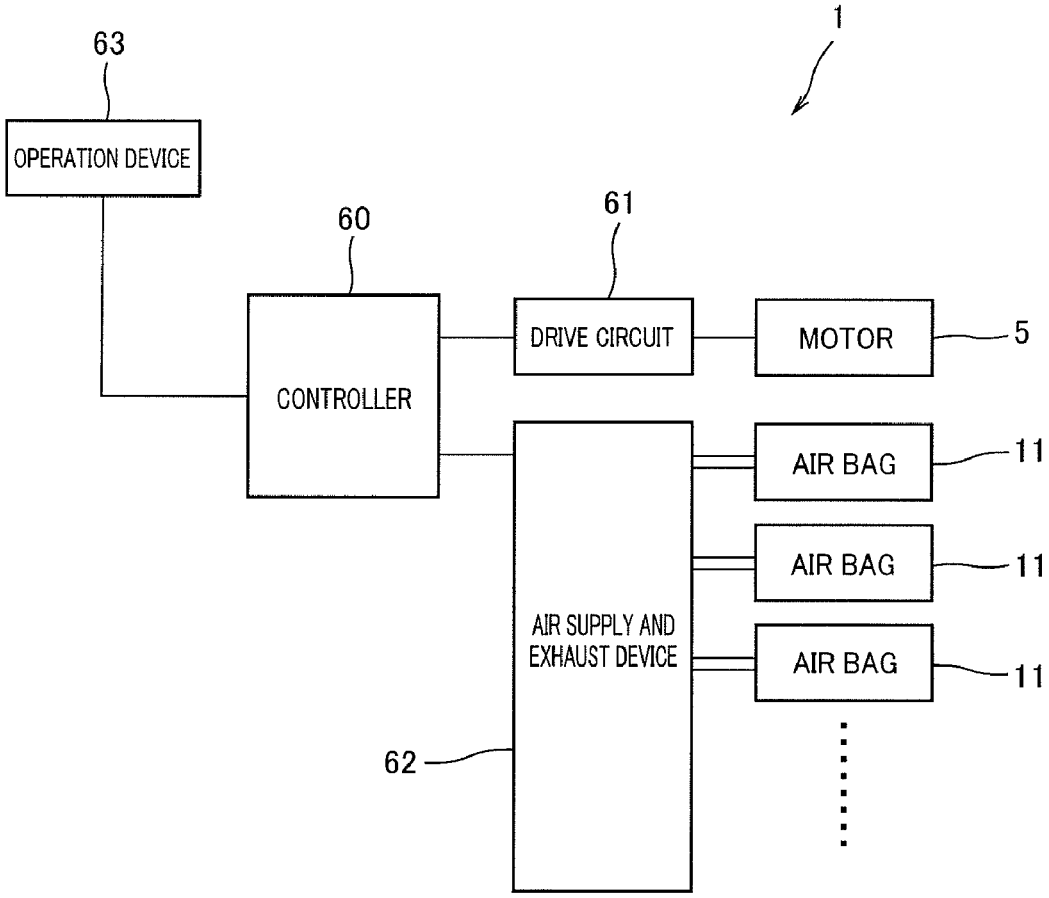
FIG. 8 is a functional block diagram of the massaging apparatus.

FIG. 1 is a perspective view showing an external configuration of a massaging apparatus 1. FIG. 2 is a plan view of the massaging apparatus 1 of FIG. 1. FIG. 8 is a functional block diagram of the massaging apparatus 1. The massaging apparatus 1 shown in FIGS. 1 and 2 serves to primarily massage body parts of the user such as a leg or an arm. During use, a part of the massaging apparatus 1 is covered with a cover which is not illustrated. It is supposed that the massaging apparatus 1 is used in a state where the massaging apparatus 1 is accommodated in a casing, which is not illustrated for easier visibility of the components illustrated.

As shown in FIGS. 1 and 2, the massaging apparatus 1 includes a base plate 2 which has a rectangular shape elongated in a rightward and leftward direction, a right massager 1*a* provided on the base plate 2 to massage, for example, a right leg, and a left massager 1*b* provided on the base plate 2 to massage, for example, a left leg. Each of the massagers 1*a* and 1*b* includes a rubbing-massage unit 3 (hereinafter referred to as "first massaging unit") for rubbing-massaging a side portion of the body part of the user, and a back surface massage unit 4 (hereinafter referred to as "second massaging unit") for press-massaging a back portion of the body part. The operation of the massaging units 3 and 4 is controlled in accordance with a control signal output from a controller 60 (see FIG. 8), in response to the user's operation of an operation device 63 coupled to the controller 60 mounted in the massaging apparatus 1.

The massagers 1*a* and 1*b* include a motor 5 whose operation is controlled by the controller 60, as a common driving source. The motor 5 is disposed at a center portion in the longitudinal direction (i.e., rightward and leftward direction) of the base plate 2. The first massaging unit 3 and the second massaging unit 4 are both driven by the motor 5, as described in detail later.

The right massager 1*a* and the left massager 1*b* have a configuration which is substantially symmetric in the rightward and leftward direction. Therefore, in the drawings, the corresponding components of the right massager 1*a* and the left massager 1*b* are designated by the same reference numerals, and hereinafter the configuration of the right massager 1*a* will be in large part described. And, the left massager 1*b* will be described as necessary.

As shown in FIGS. 1 and 2, the first massaging unit 3 for rubbing-massage in the right massager 1*a* includes side surface massaging plates 10 which are disposed opposite to each other in the rightward and leftward direction and plural air bags 11 disposed outside the side surface massaging plates 10. The second massaging unit 4 for massaging the back portion of the body part includes a back surface massaging plate 12 which is adapted to contact the back portion. As shown in FIG. 1, a driving force transmission mechanism (rubbing drive unit) 13 is provided on the base plate 2 to transmit a rotational driving force of the motor 5 to cause the side surface massaging plates 10 and the back surface massaging plate 12 to operate.

[Driving Force Transmission Mechanism]

Figure 3:
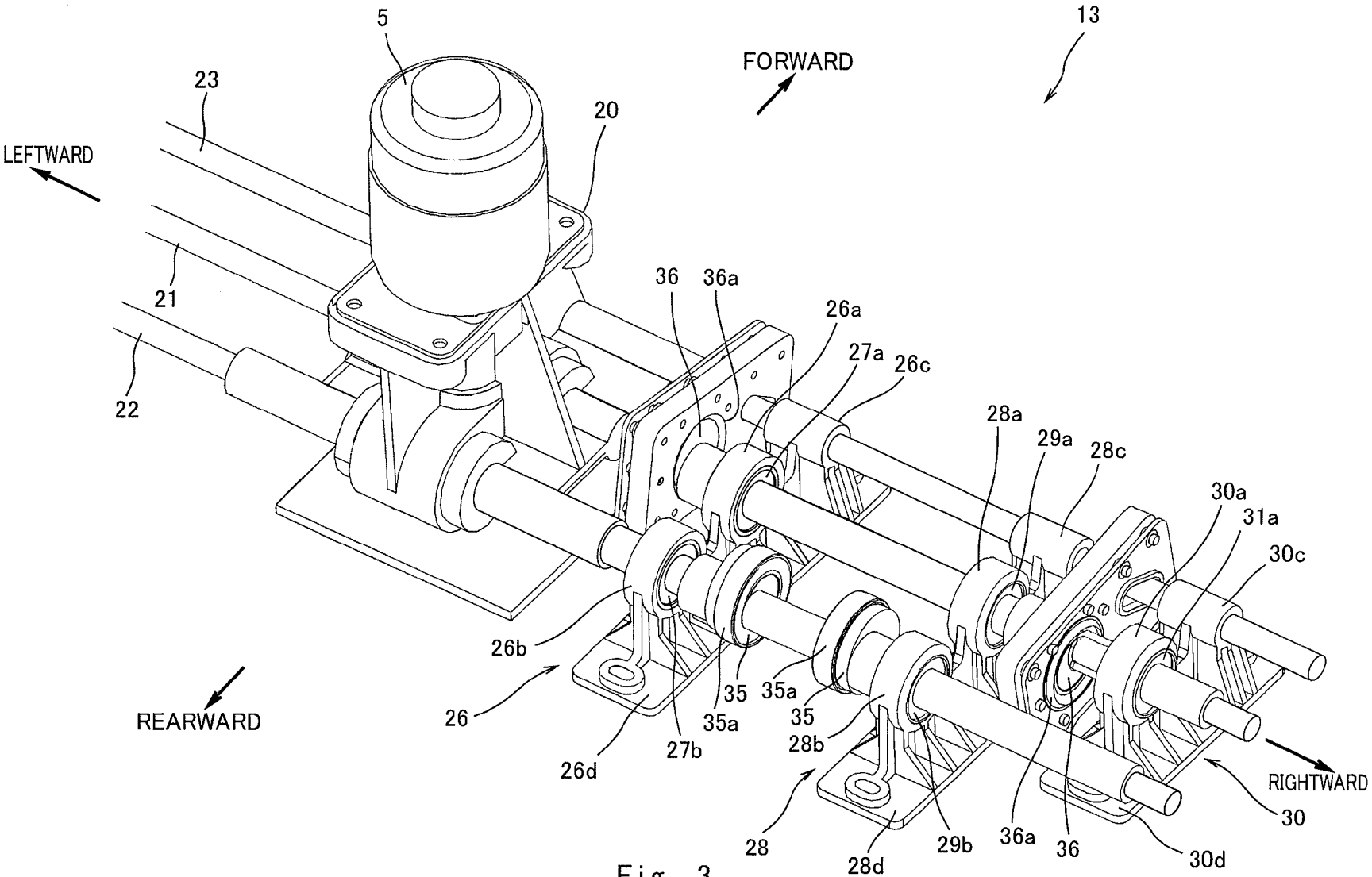
FIG. 3 is a perspective view showing a configuration of a driving force transmission mechanism of a right massager.

FIG. 3 is a perspective view showing a configuration of a driving force transmission mechanism 13 of the right massager 1*a*. Whereas the left massager 1*b* includes the driving force transmission mechanism 13 having a similar configuration as described above, this is not illustrated in FIG. 3.

As shown in FIG. 3, the driving force transmission mechanism 13 includes a gear case 20 for changing the rotational direction of an output shaft (not shown) of the motor 5, and a first transmission shaft 21 and a second transmission shaft 22 to which the rotation of the motor 5 is transmitted. The first transmission shaft 21 and the second transmission shaft 22 have a length which is substantially equal to the length of the base plate 2 (see FIG. 1). The first transmission shaft 21 and the second transmission shaft 22 are disposed above the base plate 2 with their center axes extending in the rightward and leftward direction.

The gear case 20 is fixed at a substantially center portion of the base plate 2 (see FIG. 1) in the rightward and leftward direction in a state where the first transmission shaft 21 and the second transmission shaft 22 penetrate through the gear case 20. The motor 5 is mounted to the upper portion of the gear case 20. The motor 5 is fixed to the gear case 20 in a state where its output shaft (not shown) oriented downward is inserted into the gear case 20.

Two worm gears (not shown) are accommodated in the lower portion of the gear case 20. These worm gears are coupled to the first transmission shaft 21 and to the second transmission shaft 22. The worm gears are in mesh with worm wheels (not shown) mounted to the output shaft of the motor 5. When the output shaft of the motor 5 rotates, the rotation is transmitted to the first transmission shaft 21 and the second transmission shaft 22 via the worm wheels and the worm gears, causing the first transmission shaft 21 and the second transmission shaft 22 to rotate around their center axes.

A third support shaft 23 is disposed at an opposite side of the second transmission shaft 22 with respect to the first transmission shaft 21 such that the third support shaft 23 extends in the rightward and leftward direction in parallel with the shafts 21 and 22. The third support shaft 23 is also substantially equal in length to the base plate 2 (see FIG. 1). The third support shaft 23 penetrates through the gear case 20 at a center portion thereof in the rightward and leftward direction and is supported by the gear case 20. Therefore, in a forward and rearward direction, the first transmission shaft 21 is positioned at a center, the second transmission shaft 22 is positioned behind the first transmission shaft 21, and the third support shaft 23 is positioned in front of the first transmission shaft 21.

A first holder 26 for supporting the shafts 21 to 23 is provided at the right side of the gear case 20 such that the first holder 26 is fixed on the upper surface of the base plate 2. The first holder 26 has three support portions 26*a* to 26*c* and a connecting base portion 26*d* which has a substantially rectangular plate elongated in the forward and rearward direction as viewed from above. The connecting base portion 26*d* is fastened to the upper surface of the base plate 2 by fastener means such as bolts. The shaft support portions 26*a* to 26*c* protrude upward from the upper portion of the connecting base portion 26*d*.

Among these, the shaft support portion 26*a* serves to support the first transmission shaft 21. The shaft support portion 26*a* supports by a bearing 27*a*, the first transmission shaft 21 inserted into a through-hole which opens in the rightward and leftward direction such that the first transmission shaft 21 is rotatable. The shaft support portion 26*b* serves to support the second transmission shaft 22. The shaft support portion 26*b* is positioned behind the shaft support portion 26*a*. The shaft support portion 26*b* supports by a bearing 27*b*, the second transmission shaft 22 inserted into a through-hole which opens in the rightward and leftward direction such that the second transmission shaft 22 is rotatable. The shaft support portion 26*c* serves to support the third support shaft 23. The shaft support portion 26*c* is positioned in front of the shaft support portion 26*a*. The shaft support portion 26*c* supports the third support shaft 23 inserted into a through-hole which opens in the rightward and leftward direction.

A second holder 28 is provided at the right side of the first holder 26 with a predetermined distance from the first holder 26 such that the second holder 28 is fixed to the upper surface of the base plate 2. Since the second holder 28 has a configuration similar to that of the first holder 26, a detailed description thereof is omitted. As in the first holder 26, the second holder 28 includes shaft support portions 28*a* to 28*c* for respectively supporting the shafts 21 to 23 and a connecting base portion 28*d* which is fixed to the upper portion of the base plate 2 and on which the shaft support portions 28*a* to 28*c* protrude. The shaft support portion 28*a* supports the first transmission shaft 21 via a bearing 29*a* such that the first transmission shaft 21 is rotatable. The shaft support portion 28*b* supports the second transmission shaft 22 via a bearing 29*b* such that the second transmission shaft 22 is rotatable. The shaft support portion 28*c* supports the third support shaft 23 inserted into the through-hole.

A third holder 30 is provided at the right side of the second holder 26 with a predetermined distance from the second holder 26 such that the third holder 30 is fixed to the upper surface of the base plate 2. The third holder 30 serves to support only the first transmission shaft 21 and the third support shaft 23. The third holder 30 includes shaft support portions 30*a* and 30*c* for respectively supporting the shafts 21 and 23, and a connecting base portion 30*d* which is fixed on the upper portion of the base plate 2 and on which the shaft support portions 30*a* and 30*c* protrude. The shaft support portion 30*a* supports via a bearing 31*a* the right end portion of the first transmission shaft 21 inserted into the through-hole which opens in the rightward and leftward direction such that the first transmission shaft 21 is rotatable. The shaft support portion 30*c* supports the right end portion of the third support shaft 23 inserted into the through-hole, which opens in the rightward and leftward direction.

Among the above described shafts, the shaft support portions 26*c*, 28*c*, and 30*c* for supporting the third support shaft 23 may support the third support shaft 23 such that the third support shaft 23 is fixed, rather than rotatable.

The second transmission shaft 22 is provided with two eccentric cams 35 for operating the back surface massaging plate 12 (see FIG. 1) of the second massaging unit 4. The two eccentric cams 35 are provided with a predetermined distance between them, between the first holder 26 and the second holder 28. The eccentric cam 35 has a disc-shape having a substantial thickness. The eccentric cam 35 has a rotational center axis in a position distant from a center of a geometric circle. The eccentric cams 35 are attached to the second transmission shaft 22 such that the eccentric cams 35 are rotatable integrally with the second transmission shaft 22 with the rotational center axes of the eccentric cams 35 conforming to the rotational center axis of the second transmission shaft 22. Further, the phases of the two eccentric cams 35 with respect to the rotational center axes conform to each other. Ring-shaped bearings 35*a* are externally fitted to the outer peripheral portions of the two eccentric cams 35, respectively. The eccentric cams 35 are adapted to contact the back surface massaging plate 12 via the bearings 35*a*, which will be described in detail later with reference to FIGS. 6 and 7.

The first transmission shaft 21 is provided with eccentric cams 36 for operating the side surface massaging plate 10 (see FIG. 1) of the first massaging unit 3. Two eccentric cams 36 are provided to respectively correspond to the two side surface massaging plates 10 of the first massaging unit 3. The eccentric cams 36 are provided at both sides so as to sandwich the first holder 26 and the second holder 28. To be precise, an eccentic cam 36 is positioned between the first holder 26 and the gear case 20 and another eccentric cam 36 is positioned between the second holder 28 and the third holder 30.

The eccentric cams 36 have a configuration similar to that of the eccentric cams 35. Each eccentric cam 36 has a disc-shape having a substantial thickness. The eccentric cam 36 has a rotational center axis in a position distant from a center of a geometric circle. The eccentric cams 36 are attached to the first transmission shaft 21 such that the eccentric cams 36 are rotatable integrally with the first transmission shaft 21 with the rotational center axes of the eccentric cams 36 conforming to the rotational center axis of the first transmission shaft 21. The phases of the two eccentric cams 36 with respect to the rotational center axes are 180 degrees different from each other. Ring-shaped bearings 36*a* are externally fitted to the outer peripheral portions of the two eccentric cams 36, respectively.

In the driving force transmission mechanism 13 having the above described configuration, when the motor 5 drives and the output shaft rotates, the first transmission shaft 21 and the second transmission shaft 22 rotate according to the rotation of the output shaft, causing the eccentric cams 35 and 36 to rotate. The first massaging unit 3 is operated according to the rotation of the eccentric cams 36, while the second massaging unit 4 is operated according to the rotation of the eccentric cams 35. As shown in FIG. 8, since the motor 5 is coupled to the controller 60 via a drive circuit 61, the operation of the motor 5 is controlled in accordance with an electric signal output from the drive circuit 61 based on a control signal from the controller 60.

[First Massaging Unit]

Figure 4:
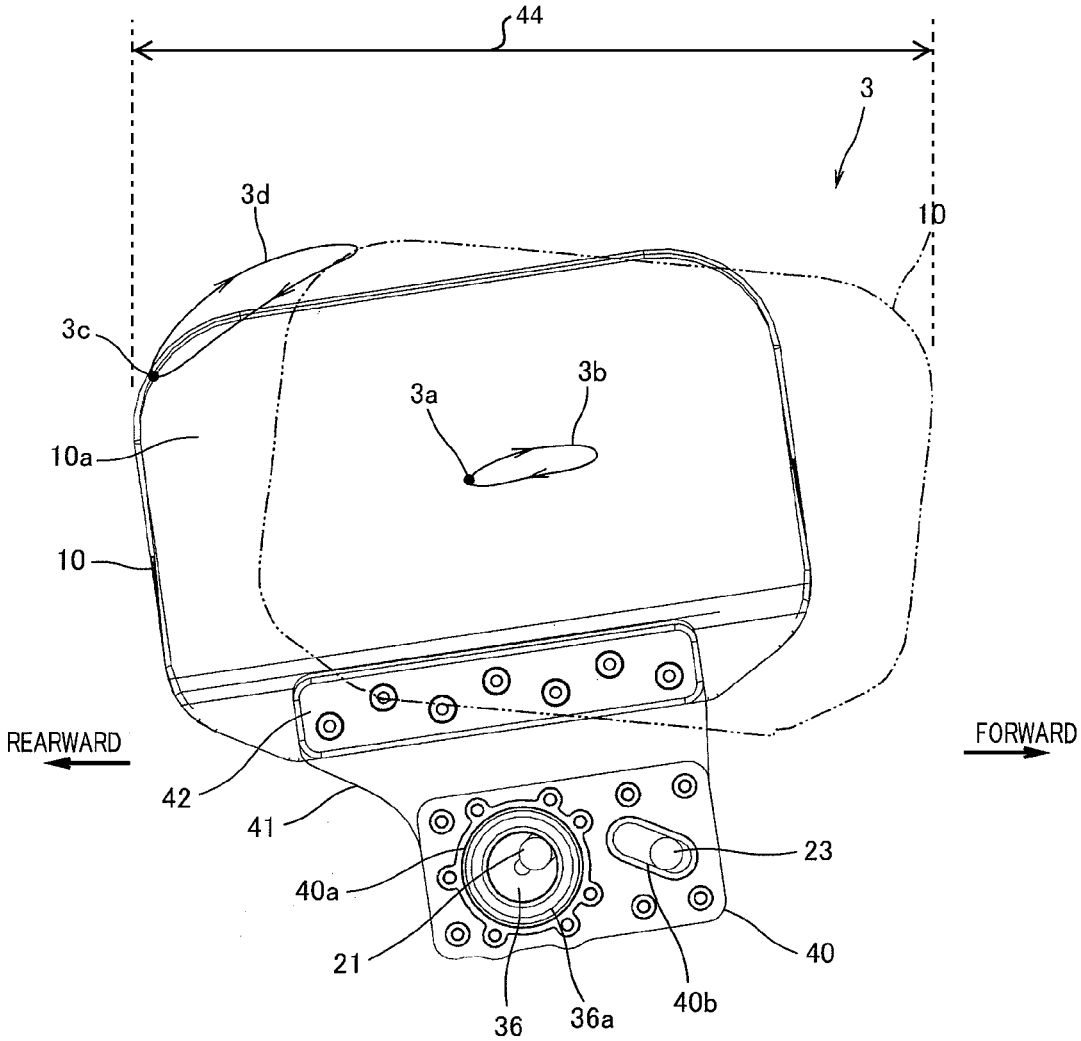
FIG. 4 is a side view showing a configuration of a part of a first massaging unit, and showing a left side surface massaging plate of the right massager and its associated configuration.

FIG. 4 is a side view showing a configuration of a part of the first massaging unit 3, and showing the left side surface massaging plate 10 of the right massager 1*a* and its associated configuration. As shown in FIG. 4, the first massaging unit 3 includes a connecting plate 40 into which the first transmission shaft 21 and the third support shaft 23 are inserted. The connecting plate 40 has a substantially rectangular shape which is elongated in the forward and rearward direction as viewed from the side. The connecting plate 40 has a cam receiver hole 40*a* having a circular opening and a shaft receiver hole 40*b* being located in front of the cam receiver hole 40*a* and having an opening of an elongated-circle shape. The eccentric cam 36 attached to the first transmission shaft 21 as described above is internally fitted to the cam receiver hole 40*a* via the bearing 36*a*. The third support shaft 23 is inserted into the shaft receiver hole 40*b*. The third support shaft 23 and the shaft receiver hole 40*b* are relatively movable along the longitudinal direction of the shaft receiver hole 40*b*.

The side surface massaging plate 10 shown in FIG. 1 is disposed with a predetermined distance above the connecting plate 40. The connecting plate 40 is coupled to the side surface massaging plate 10 via a hinge plate 41 made of synthetic resin having a suitable flexibility. To be specific, as shown in FIG. 4, the side surface massaging plate 10 has a substantially rectangular shape which is slightly elongated in the forward and rearward direction and has rounded corner portions as viewed from the side. The side surface massaging plate 10 has an opposite surface 10*a* which is opposite to the other side surface massaging plate 10 of the pair of side surface massaging plates 10. The opposite surface 10*a* has raised fabrics. A joint plate 42 forming a rectangular shape which is elongated in the forward and rearward direction is provided at the lower portion of the side surface massaging plate 10 so as to extend along a lower end side of the side surface massaging plate 10. The joint plate 42 is longer than the connecting plate 40 in the dimension in the forward and rearward direction.

The lower portion of the hinge plate 41 is substantially equal to the connecting plate 40 in the dimension in the forward and rearward direction, while the upper portion of the hinge plate 41 is substantially equal to the joint plate 42 in the dimension in the forward and rearward direction. The lower portion of the hinge plate 41 is coupled to the connecting plate 40 by fastener means, such as bolts. The hinge plate 41, the side surface massaging plate 10 and the joint plate 42 are coupled to each other by a fastener means such as bolts such that the upper portion of the hinge plate 41 is retained between the lower portion of the side surface massaging plate 10 and the joint plate 42. Therefore, the side surface massaging plate 10 is movable in the rightward and leftward direction with respect to the connecting plate 40 and is able to twist around a vertically extending axis.

Subsequently, the operation of the first massaging unit 3 having the above described configuration will be described. When the motor 5 drives and the first transmission shaft 21 rotates, the eccentric cams 36 revolve around the rotational center axis of the first transmission shaft 21. According to this revolution, the cam receiver hole 40*a* of the connecting plate 40 circularly moves along a revolution orbit of the eccentric cams 36. Since the third shaft 23 is inserted into the shaft receiver hole 40*b* of the connecting plate 40, the circular movement of the connecting plate 40 is restricted regardless of the circular movement of the cam receiver hole 40*a*. As a result, when the first transmission shaft 21 is rotating once, the connecting plate 40 moves along a revolving orbit in such a manner that the connecting plate 40 reciprocates once by a predetermined distance in the forward and rearward direction and tilts forward and rearward.

According to the operation of the connecting plate 40, the side surface massaging plate 10 also moves along the revolving orbit in such a manner that, while the side surface massaging plate 10 is reciprocating once by a predetermined distance in the forward and rearward direction, the massaging plate 10 tilts forward and rearward. In this case, as shown in FIG. 4, a fixed point 3*a* located substantially at a center of the side surface massaging plate 10 moves along a revolving orbit 3*b* of a substantially-oval shape which is elongated in the forward and rearward direction, while a fixed point 3*c* located at an upper end rear portion of the side surface massaging plate 10 moves along a revolving orbit 3*d* which is longer than the revolving orbit 3*b*.

As described above, the phases of the right and left eccentric cams 36 of the first massaging unit 3 are 180 degrees different from each other. Therefore, since the phases of the right and left side surface massaging plates 10 are different from each other by 180 degrees during the movement along the revolving orbit, they move in opposite directions. When one side surface massaging plate 10 is moving forward, the other side surface massaging plate 10 is moving rearward.

The first massaging unit 3 having the above described configuration, is operated in a state where the body part of the user is positioned between the pair of side surface massaging plates 10 which are opposite to each other as shown in FIG. 1. As described above, the right and left side surface massaging plates 10 move along a fixed revolving orbit in the forward and rearward direction and slidably contact the side surfaces of the body part. Both of the side portions of this body part are subjected to rubbing-massage. Since the opposite surfaces 10*a* (i.e., surfaces which contact the body part) have raised fabrics, friction resistance generated because of the slidable contact between the body part and the opposite surfaces 10*a* of the side surface massaging plates 10 is reduced. In this manner, desirable rubbing-massage is carried out.

The revolving orbit of the side surface massaging plate 10 is determined by the diameter of the eccentric cam 36, the tilting angle of the shaft receiver hole 40*b* in the longitudinal direction, etc. In this embodiment, since the shaft receiver hole 40*b* is not an elongated circle extending horizontally but has a predetermined tilting angle with respect to a horizontal direction, the side surface massaging plate 10 moves along a peculiar orbit rather than a simple revolving orbit. Whereas in this embodiment, the shaft receiver hole 40*b* is configured to be tilted in this way, its longitudinal direction may be set to the horizontal direction, or otherwise the shaft receiver hole 40*b* may be configured to be tilted by a larger angle. The diameter of the eccentric cams 36 may be suitably set according to a desired reciprocating distance 44 of the side surface massaging plate 10.

Figure 5:
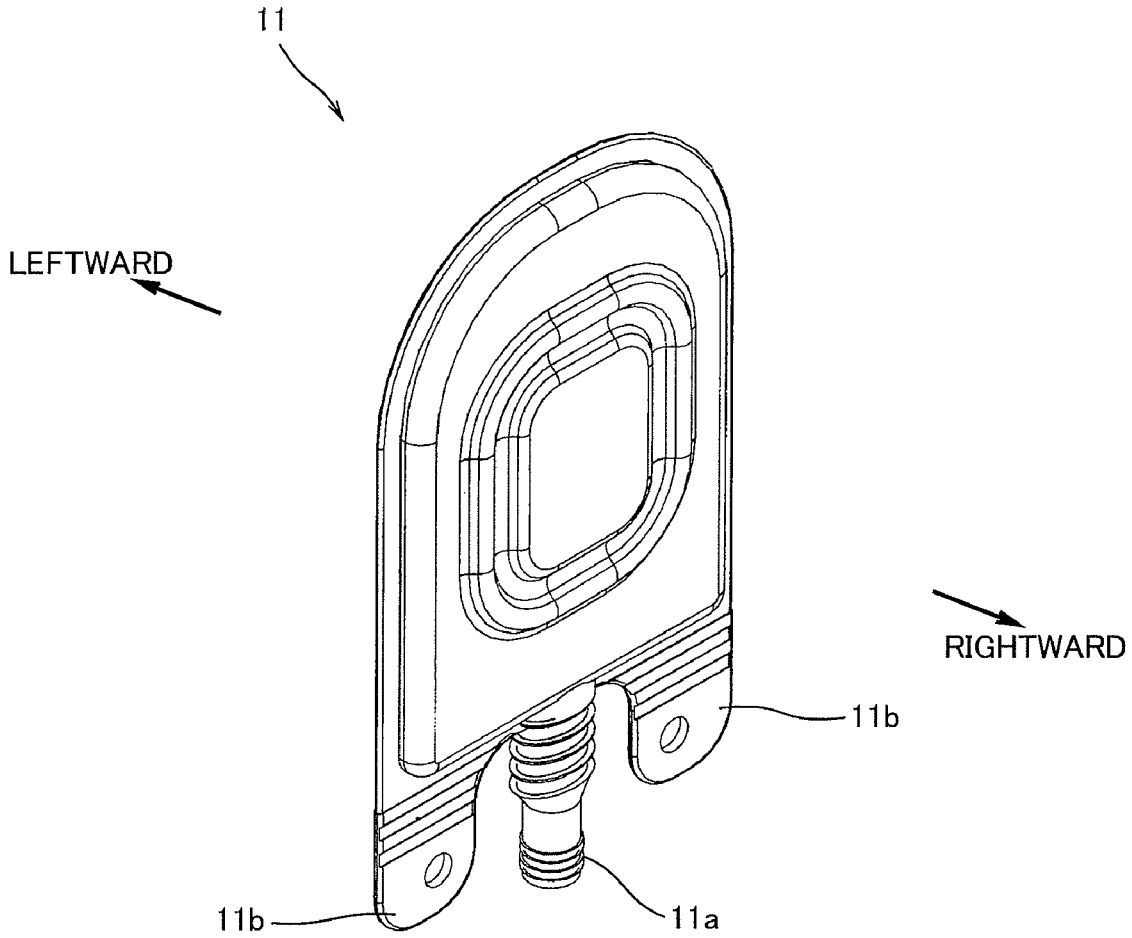
FIG. 5 is a perspective view showing a configuration of an air bag of the first massaging unit.

FIG. 5 is a perspective view showing a configuration of the air bag 11 of the first massaging unit 3. As shown in FIG. 5, the air bag 11 is flat in the rightward and leftward direction and has a substantially rectangular shape as viewed from the side. A pipe-shaped air supply and exhaust port 11*a* is provided at the lower portion of the air bag 11 and opens downward. Through the air supply and exhaust port 11*a*, air is supplied from an air supply and exhaust device 62 (see FIG. 8) to the air bags 11 and exhausted from the air bag 11 to the air supply and exhaust device 62. By supplying air to and exhausting air from the air supply and exhaust device 62 through an air hose, the air bag 11 is expanded and contracted. Flanges 11*b* are provided at both sides in the forward and rearward direction adjacent to the air supply and exhaust port 11*a*. The air bag 11 is mounted to the casing (not shown) accommodating the massaging apparatus 1 or the base plate 2 (see FIG. 1), via the flanges 11*b*. As shown in FIG. 8, the air supply and exhaust device 62 is coupled to the controller 60. The operation of the air supply and exhaust device 62 is controlled in accordance with a control signal from the controller 60.

As shown in FIGS. 1 and 2, plural air bags 11 are arranged outside (at an opposite side where the body part of the user is placed) the side surface massaging plate 10. To be specific, a wall surface 1*c* (indicated by two-dotted line in FIGS. 1 and 2) is positioned at the right side of the right side surface massaging plate 10 with a predetermined distance. Between the right massaging plate 10 and the wall surface 1*c* of the casing, air bag units 45 each including three air bags 11 stacked in the rightward and leftward direction are arranged at a front side and a rear side, and respectively support the side surface massaging plate 10 from a right side.

At the left side of the left side surface massaging plate 10, air bag units 46 each including two air bags 11 stacked in the rightward and leftward direction are arranged at a front side and a rear side. As shown in FIG. 2, the left front air bag unit 46 of the right massager 1*a* is disposed in close proximity to the right front air bag unit 46 of the left massager 1*b* such that these air bag units 46 are arranged in a back-to-back manner. On the other hand, the left rear air bag unit 46 of the right massager 1*a* is disposed to be distant from the right rear air bag unit 46 of the left massager 1*b*, and a motor 5 is disposed between them. These air bag units 46 support the left side surface massaging plate 10 from a left side.

In such a configuration, when the air is supplied to the air bags 11 of the right massager 1*a*, the right air bag units 45 and the left air bag units 46 are expanded. Since the outer side surfaces of the right air bag units 45 are supported by the wall surface 1*c* of the casing, they are expanded toward the side surface massaging plate 10, pushing the side surface massaging plate 10 to the left side. On the other hand, since the outer wall surfaces of the left air bag units 46 are supported by the air bag units 46 of the left massager 1*b*, they are expanded toward the side surface massaging plate 10, pushing the massaging plate 10 to the right side. As a result, the right and left side surface massaging plates 10 operate to be closer to each other. Conversely, when the air is exhausted from the air bag units 45 and 46, they are contracted, and the side surface massaging plates 10 operate to be away from each other. Also, when the motor 5 causes the side surface massaging plates 10 to be moving along the revolving orbit, a distance between the right and left side surface massaging plates 10 is changed by supplying the air to the air bags 11.

In the manner described above, the distance between the right and left massaging plates 10 is adjustable according to a dimension of the body part of the user which is subjected to rubbing-massage. Thus, rubbing-massage is performed by a proper pressing force. Such position adjustment of the side surface massaging plate 10 according to the expansion and contraction of the air bags 11 can be carried out even during a rubbing-massage operation of the side surface massaging plates 10. Therefore, during the rubbing-massage, the user can adjust the pressing force (frictional force during the rubbing massage) applied to the body part by the side surface massaging plates 10 according to the expansion and contraction of the air bags 11 according to the user's preference, without stopping the rubbing-massage.

Receiving a pressure from the body part of the user via the side surface massaging plate 10, the air bags 11 are properly deformed. Therefore, the air bags 11 are deformed suitably according to the shape of the body part. The side surface massaging plate 10 performs the rubbing-massage in such a manner that the side surface massaging plate 10 slidably contacts the side surface of the body part in a state where the side surface massaging plate 10 is in contact with the body part with a proper pressing force.

Alternatively, air supply and exhaust may be performed independently for the air bag units 45 and the air bag units 46 arranged forward and rearward to enable these air bag units to be expanded in different manners. For example, when the lower leg is rubbing-massaged, the right and left air bag units 45 and 46 at the front side corresponding to the ankle and its vicinity, having a relatively small dimension in the rightward and leftward direction, may be expanded with a larger amount, while the right and left air bag units 45 and 46 at the rear side corresponding to the knee and its vicinity, having a relatively large dimension in the rightward and leftward direction, may be expanded with a smaller amount. In this way, proper rubbing-massage according to the change in shape of the body part is attainable.

In this embodiment, the air bags 11 are arranged forward and rearward to correspond to the length of the reciprocating distance 44 of the side surface massaging plate 10. As noted above, the air bags may be arranged to have a length 14 corresponding to the reciprocating distance 44 of the massaging plates. Therefore, when the side surface massaging plate 10 is in a foremost position or in a rearmost position during the reciprocation, the side surface massaging portion 10 can maintain the state where it is supported by the air bags 11.

Whereas in this embodiment, each air bag unit 45 includes three air bags 11 and each air bag unit 46 includes two air bags 11, the number of the air bags 11 is not limited to this. Whereas the two air bag units 45 are arranged forward and rearward and the two air bag units 46 are arranged forward and rearward, only one air bag unit may be provided using air bags elongated in the forward and rearward direction, or three or more air bag units may be arranged in the forward and rearward direction.

[Second Massaging Unit]

Figure 6:
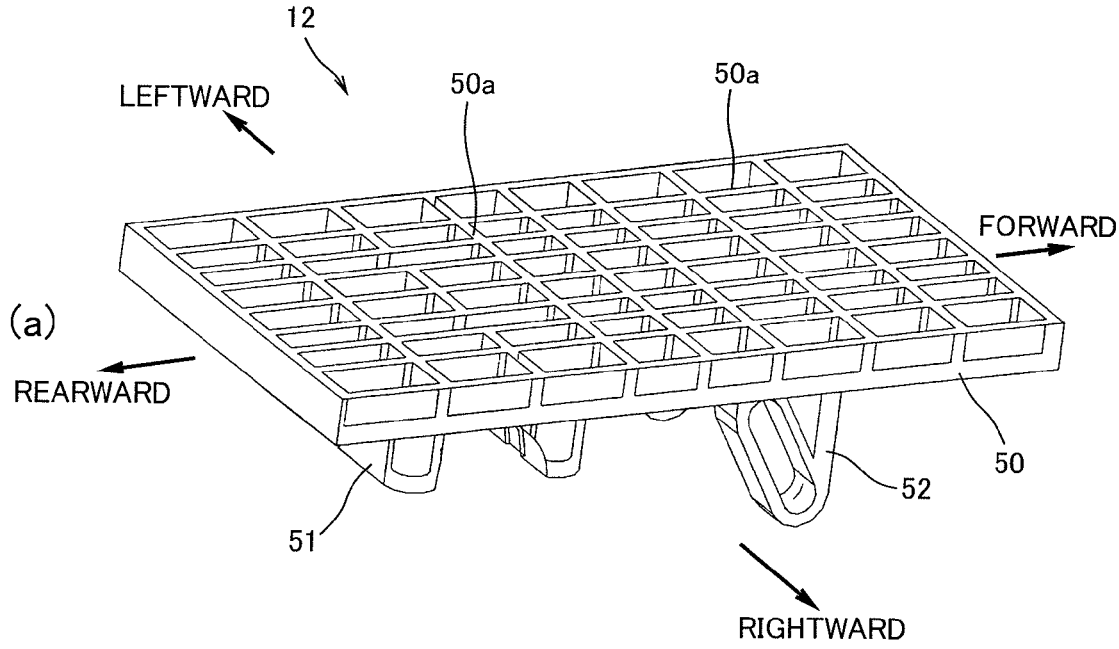
FIG. 6 is a perspective view showing a configuration of a back surface massaging plate of a second massaging unit for massaging a back portion of a body part, wherein FIG. 6(*a*) shows a configuration as viewed from obliquely above and FIG. 6(*b*) shows a configuration as viewed from obliquely below.
Figure 6:
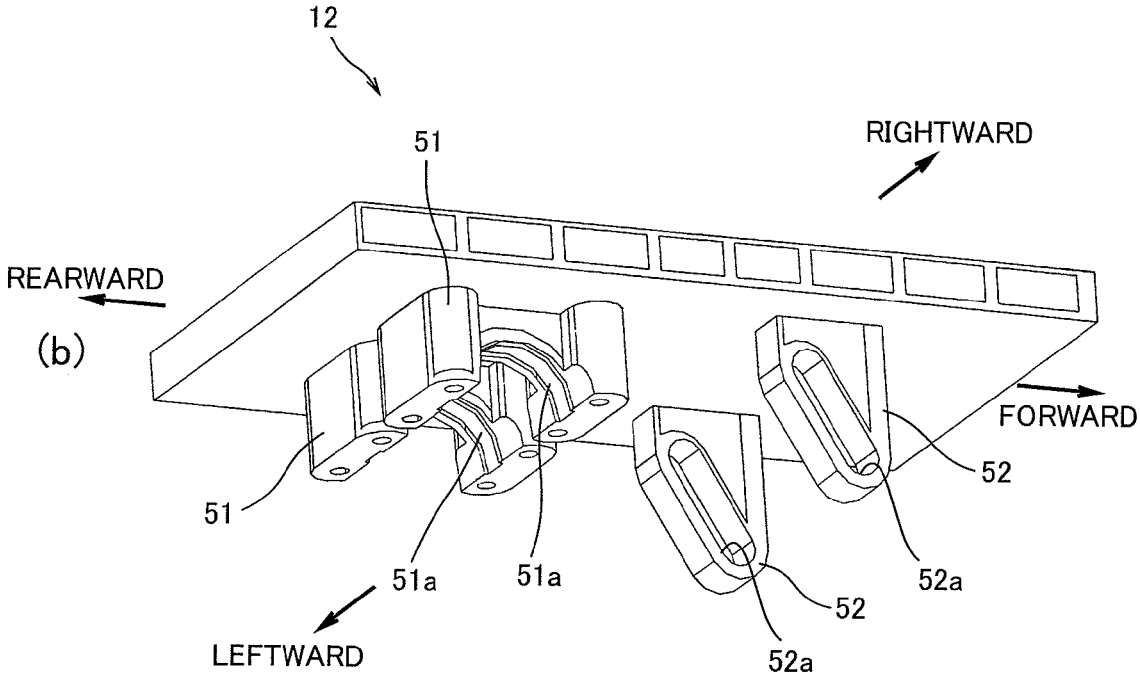
Figure 7:
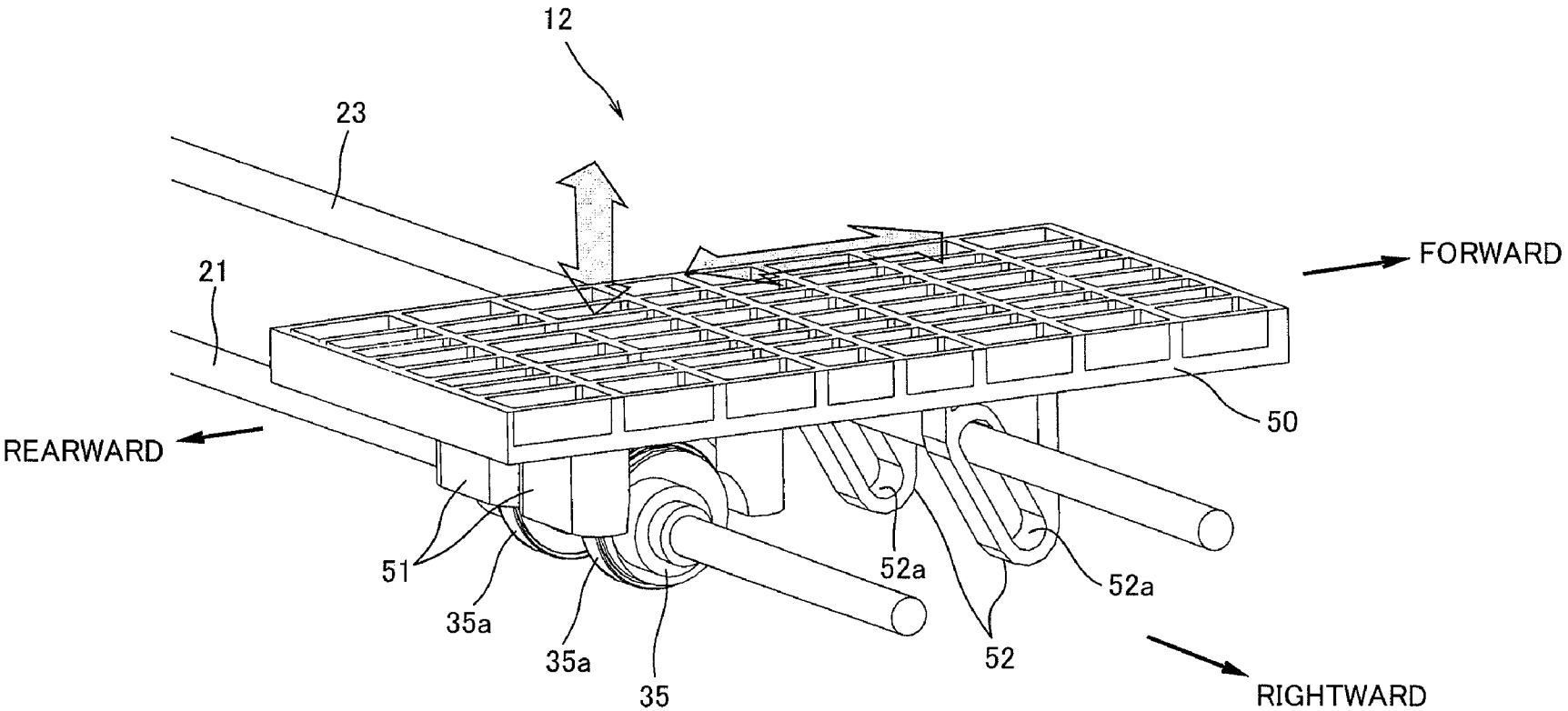
FIG. 7 is a perspective view showing a connecting configuration of the back surface massaging plate of FIG. 6, a second transmission shaft and a third support shaft.

FIG. 6 is a perspective view showing a configuration of a back surface massaging plate 12 of a second massaging unit 4 for massaging the back portion of the body part, wherein FIG. 6(*a*) shows a configuration as viewed from obliquely above and FIG. 6(*b*) shows a configuration as viewed from obliquely below. FIG. 7 is a perspective view showing a connecting configuration of the back surface massaging plate 12, the second transmission shaft 22 and the third support shaft 23. The back surface massaging plate 12 has a substantially rectangular shape as viewed from above. As shown in FIG. 6(*a*), the back surface massaging plate 12 has a pressing plate 50 on which plural ribs 50*a* protrude so as to extend in the forward and rearward direction and in the rightward and leftward direction.

As shown in FIG. 6(*b*), two cam receiver members 51 arranged rightward and leftward protrude downward from the lower surface of the pressing plate 50, while two shaft receiver members 52 arranged rightward and leftward protrude downward from the low surface of the pressing plate 50 in the same manner. Each cam receiver member 51 has a cam receiver surface 51*a* which is recessed upward in a circular-arc shape so as to conform to the outer shape of the eccentric cam 35 (see FIG. 3). Each shaft receiver member 52 has a shaft receiver hole 52*a* having an elongated-circle opening penetrating through the shaft receiver member 52 in the rightward and leftward direction. The shaft receiver hole 52*a* extends downward in a direction from a rear portion toward a front portion such that its longitudinal direction is tilted.

As shown in FIG. 7, the above described back surface massaging plate 12 is provided to extend over the first transmission shaft 21 and the third support shaft 23. The cam receiver surface 51*a* of the back surface massaging plate 12 is in contact with the eccentric cam 35 provided at the first transmission shaft 21 via the bearing 35*a* such that the cam receiver surface 51*a* covers the eccentric cam 35 from above. The third support shaft 23 is inserted into the shaft receiver hole 52*a* of the shaft receiver member 52. The third support shaft 23 and the shaft receiver hole 52*a* are movable relative to each other along the longitudinal direction of the shaft receiver hole 52*a*.

In the above second massaging unit 4, when the motor 5 drives and its output shaft rotates, the rotation is transmitted to the eccentric cam 35 via the driving force transmission mechanism 13. Since the back surface massaging plate 12 is in contact with the eccentric cam 35 via the bearing 35*a*, the eccentric cam 35 slidably rotates with respect to the cam receiver surface 51*a* of the back surface massaging plate 12. According to this rotation, the back surface massaging plate 12 reciprocates in a substantially vertical direction and in the forward and rearward direction. Since the back surface massaging plate 12 is supported by the third support shaft 23 by the shaft receiver hole 52*a*, the back surface massaging plate 12 reciprocates as described above and tilts in the forward and rearward direction.

When the second massaging unit 4 operates in the state where the body part of the user is placed on the upper surface of the back surface massaging plate 12, the back surface massaging plate 12 slightly rubbing-massages and press-massages the back portion of the body part along the longitudinal direction thereof. Since the motor 5 serves as a driving source for the first massaging unit 3 and the second massaging unit 4, the operation of the first massaging unit 3 and the operation of the second massaging unit 4 are carried out simultaneously. Thus, both the first massaging unit 3 and the second massaging unit 4 massage the body part of the user.

[Another Configuration of Second Massaging Unit]

Figure 9:
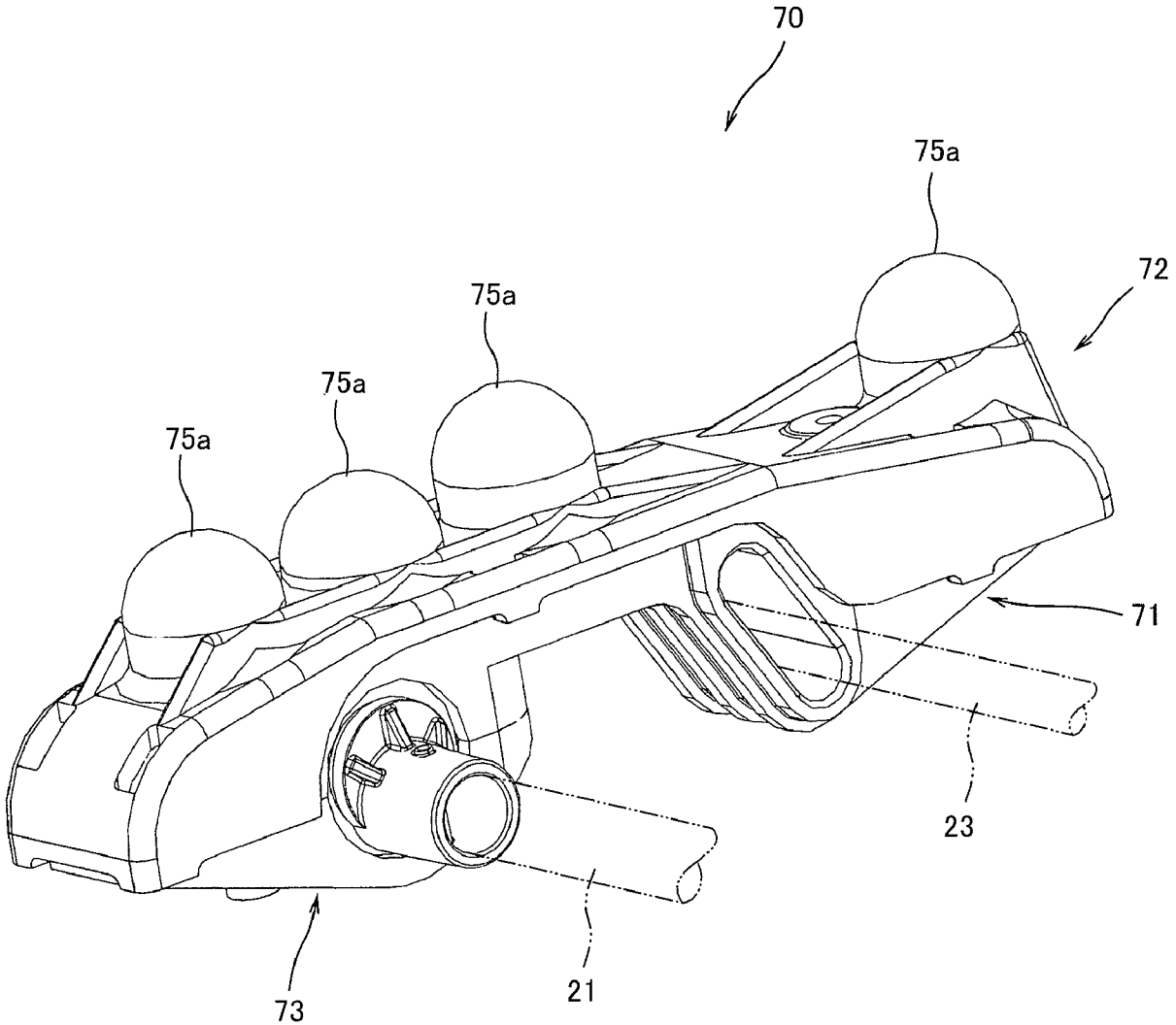
FIG. 9 is a perspective view showing a configuration of a back surface massaging unit which replaces the back surface massaging plate of FIG. 6, as another configuration of the second massaging unit.
Figure 10:
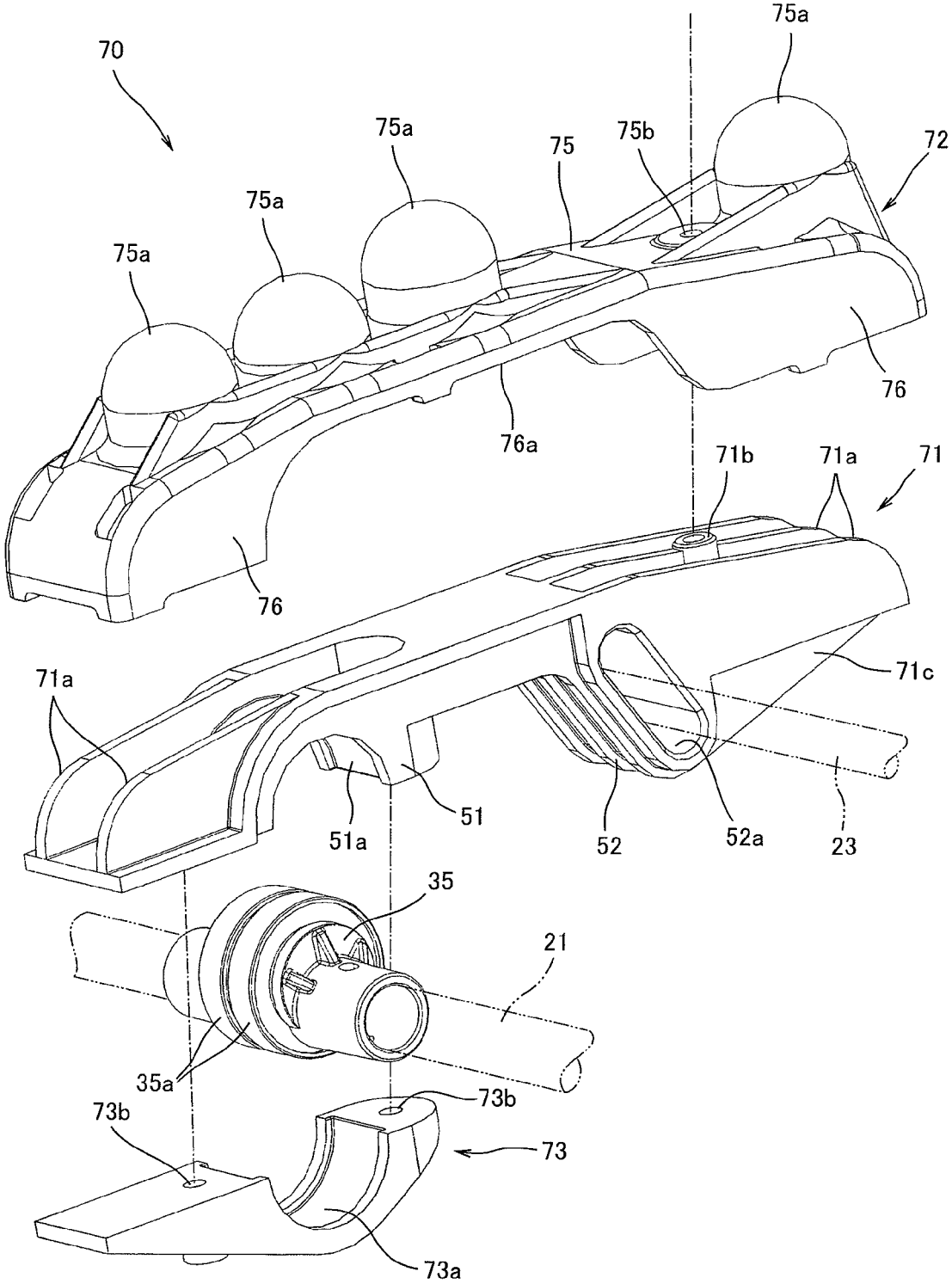
FIG. 10 is an exploded perspective view of the back surface massaging unit of FIG. 9.

FIG. 9 is a perspective view showing a configuration of a back surface massaging unit 70 which replaces the back surface massaging plate 12, as another configuration of the second massaging unit 4. FIG. 10 is an exploded perspective view of the back surface massaging unit 70. As shown in FIG. 10, the back surface massaging unit 70 includes a massaging unit body 71 which is inserted with the third support shaft 23 and is vertically moved by the eccentric cam 35, a massaging unit body cover 72 which covers the upper portion of the massaging unit body 71 and applies a pressing stimulus to the user, and a bearing holder 73 which is coupled to the massaging unit body 71 from below and supports the eccentric cams 35 provided at the first transmission shaft 21.

Referring now to FIG. 10, the massaging unit body 71 is elongated in the forward and rearward direction. The massaging unit body 71 has plate-shaped ribs 71*a* extending in the forward and rearward direction at the front upper portion and at the rear upper portion thereof. In addition, a threaded hole 71*b* is provided at the front upper portion of the massaging unit body 71 to extend downward to an intermediate position inside the massaging unit body 71. A shaft receiver member 52 having a shaft receiver hole 52*a* similar to that shown in FIG. 6 is provided at the front lower portion of the massaging unit body 71 in a position behind the threaded hole 71*b*. A cam receiver member 51 having a cam receiver surface 51*a* similar to that shown in FIG. 6 is provided at the rear lower portion of the massaging unit body 71 in a position in front of the rear rib 71*a*. Further, a rib 71*c* is provided at the front lower portion of the massaging unit body 71. The rib 71*c* serves to reinforce the shaft receiver member 52.

The massaging unit body cover 72 is elongated in the forward and rearward direction as in the massaging unit body 71, and is formed such that a lower portion thereof is recessed upward by an upper wall 75 and right and left side walls 76. A threaded hole 75*b* is provided at the front portion of the upper wall 75 so as to vertically penetrate therethrough and so as to correspond to the threaded hole 71*b* of the massaging unit body 71. Furthermore, plural massaging elements 75*a* having a semi-spherical shape protrude upward from the upper surface of the upper wall 75. In this embodiment, four massaging elements 75*a* in total are provided such that one massaging element 75*a* is provided in front of the threaded hole 75*b* and three massaging elements 75*a* are provided behind the threaded hole 75*b*. The massaging unit body cover 72 covers the massaging unit body 71 from above. Threaded members (not shown) are respectively threaded into the threaded holes 71*b* and 75*b* to couple the massaging unit body cover 72 to the massaging unit body 71. A cut portion 76*a* is formed at right and left side walls 76 of the massaging unit body cover 72 such that the cut portion 76*a* is located at a center portion in the forward and rearward direction. In the state where the massaging unit body cover 72 is coupled to the massaging unit body 71, the cam receiver members 35 and the shaft receiver members 52 are positioned within the cut portion 76*a*.

A bearing holder 73 has a substantially inverted-triangle shape as viewed from the side. The bearing holder 73 has at an upper portion thereof a cam receiver surface 73*a* which is recessed downward in a circular-arc shape so as to conform to the outer shape of the eccentric cam 35. The cam receiver surface 73*a* has a radius equal to a radius of the cam receiver surface 51*a* of the cam receiver member 51 of the massaging unit body 71. The bearing holder 73 is coupled to the rear portion of the massaging unit body 71 from below. To be specific, the bearing holder 73 is coupled to the massaging unit body 71 such that the cam receiver surfaces 51*a* and 73*a* form a perfect circle, and are fastened to each other by threading from below threaded members (not shown) through threaded holes 73*b* formed in the front portion and the rear portion of the bearing holder 73.

As in the back surface massaging plate 12 shown in FIG. 7, in the back surface massaging unit 70 having such a configuration, when the motor 5 drives and its output shaft rotates, the rotation is transmitted to the eccentric cams 35 via the driving force transmission mechanism 13. Since the back surface massaging unit 70 is in contact with the eccentric cams 35 via the bearings 35*a*, the eccentric cams 35 slidably rotate with respect to the cam receiver surfaces 51*a* and 73*a* of the back surface massaging unit 70. According to this rotation, the back surface massaging unit 70 reciprocates in the substantially vertical direction and in the forward and rearward direction.

When the second massaging unit 4 operates in the state where the body part of the user is placed on the upper surface (surfaces of the massaging elements 75*a*) of the back surface massaging unit 70, the massaging elements 75*a* of the back surface massaging unit 70 slightly rubbing-massages and press-massages the back portion of the body part along the longitudinal direction thereof. In the back surface massaging unit 70 shown in FIGS. 9 and 10, the semi-spherical massaging elements 75*a* contact the body part of the user. Therefore, the back surface massaging unit 70 is capable of applying a stimulus with a strong pressing force to a smaller region of the surface of the body part, as compared to the back surface massaging plate 12 shown in FIGS. 6 and 7.

Industrial Applicability

The present invention is applicable to a massaging apparatus capable of properly performing rubbing-massage with respect to a body part of a user having various shapes.

The invention claimed is:

1. A massaging apparatus comprising:

a rubbing unit including:

a pair of massaging plates which are adapted to be disposed at both sides of a body part of a user so as to sandwich the body part;

a rubbing driving unit configured to cause the massaging plates to reciprocate in a direction along a side surface of the body part; and air bags which are disposed outside the massaging plates and are expanded and contracted by air supply and exhaust, to change a distance between the pair of massaging plates;

wherein the massaging plates are adapted to be reciprocatable along the side surface of the body part in a state where the air bags are expanded;

wherein during reciprocation of the massaging plates in the direction along the sides surface of the body part, the air bags do not move in the direction along the side surface of the body part; and wherein the rubbing driving unit moves the massaging plates in opposite directions.

2. The massaging apparatus according to claim 1, wherein the massaging plates are coupled to the rubbing driving unit by a hinge member having flexibility.

3. The massaging apparatus according to claim 1, wherein the air bags are expandable and contractable during reciprocation of the massaging plates.

4. The massaging apparatus according to claim 1, wherein the pair of massaging plates have opposite surfaces which are formed with fabrics.

5. The massaging apparatus according to claim 4, wherein the air bags are arranged to have a length corresponding to a reciprocating distance of the massaging plates.

6. The massaging apparatus according to claim 1, wherein a plurality of air bags are provided along a direction in which the massaging plates reciprocate.

7. The massaging apparatus according to claim 1, Further comprising:

a back surface massaging unit adapted to massage a back portion of the body part, wherein the back surface massaging unit is operable in association with the rubbing unit.

* * * * *